US009609938B1

(12) United States Patent
Wilson

(10) Patent No.: US 9,609,938 B1
(45) Date of Patent: Apr. 4, 2017

(54) WATERPROOF BACKPACKS AND CARRYING BAGS

(71) Applicant: Timbuk 2 Designs, Inc., San Francisco, CA (US)

(72) Inventor: Donald Wilson, Victoria (AU)

(73) Assignee: TIMBUK 2 DESIGNS, INC., San Francisco, CA (US)

( * ) Notice: Subject to any disclaimer, the term of this patent is extended or adjusted under 35 U.S.C. 154(b) by 0 days.

(21) Appl. No.: 15/041,708

(22) Filed: Feb. 11, 2016

(51) Int. Cl.
*A45F 3/04* (2006.01)
*A45C 13/10* (2006.01)

(52) U.S. Cl.
CPC ..... *A45F 3/04* (2013.01); *A45C 13/103* (2013.01)

(58) Field of Classification Search
CPC ..... A45F 3/04; A45C 13/103; A45C 13/1023; A45C 13/10
USPC ..... 224/654–659
See application file for complete search history.

(56) References Cited

U.S. PATENT DOCUMENTS 2,407,787 A * 9/1946 Kernahan ..... A45F 3/04 224/236
4,213,549 A * 7/1980 Hibbard ..... A45F 3/04 224/153
4,421,150 A * 12/1983 Masters ..... A45C 11/22 206/811
5,209,384 A * 5/1993 Anderson ..... B25H 3/00 224/223
5,540,366 A * 7/1996 Coomber ..... A41F 9/002 224/587
5,797,529 A * 8/1998 Lavine ..... A45C 7/0077 190/103
6,053,382 A * 4/2000 Wyant ..... A45F 3/042 190/103
6,073,772 A * 6/2000 Forbes ..... A01M 31/00 190/903
6,189,750 B1 2/2001 Von Neumann
6,315,178 B1 11/2001 Nobata
7,267,135 B2 9/2007 Hardee et al.
8,157,139 B2 4/2012 Keeler
8,302,749 B2 11/2012 Melmon et al.
8,893,940 B2 11/2014 Green et al.
(Continued)

FOREIGN PATENT DOCUMENTS

EP 2016852 A1 1/2009

*Primary Examiner* — Corey Skurdal
(74) *Attorney, Agent, or Firm* — Vierra Magen Marcus LLP

(57) ABSTRACT

A pack, which may or may not be a backpack, includes a pack portion made of a flexible material and includes a main interior storage compartment. The pack includes a foldable flap including a front region having an upper portion that, when the foldable flap is unfolded, faces outward and is visible. An aperture, which is included in upper portion of the front region of the foldable flap, is selectively openable when the foldable flap is unfolded to provide access to the main interior storage compartment. The foldable flap can be folded back over itself twice to provide a waterproof barrier against water or other moisture entering the main interior storage compartment of the pack through the aperture. Unlike a typical roll-top backpack, a height of the pack when the foldable flap is unfolded is substantially the same as when the foldable flap is folded back over itself twice.

24 Claims, 6 Drawing Sheets

(56) References Cited

U.S. PATENT DOCUMENTS

| | | | | |
|---|---|---|---|---|
| 2006/0032883 | A1* | 2/2006 | Moreno | A45F 3/04 224/627 |
| 2007/0215663 | A1* | 9/2007 | Chongson | A45C 1/04 224/650 |
| 2010/0232731 | A1* | 9/2010 | Shaul | A45C 13/002 383/37 |
| 2013/0243354 | A1* | 9/2013 | Lytle | A45C 3/00 383/59 |
| 2014/0254956 | A1* | 9/2014 | Buell, III | B65D 33/00 383/64 |
| 2015/0257517 | A1* | 9/2015 | Holtz | A45F 4/02 224/645 |

* cited by examiner

WATERPROOF BACKPACKS AND CARRYING BAGS

BACKGROUND

There are various different types of backpacks with various different shapes and features that are manufactured and sold. Tombstone shaped backpacks are very popular because their main interior storage compartment can be easily accessed via their inverted u-shaped zipper closure that tracks around an inverted u-shaped aperture in an upper periphery of such backpacks. However, tombstone shaped backpacks that include an inverted u-shaped zipper closure are typically not waterproof, unless very heavyweight and expensive waterproof zippers are utilized, such as those sold by TITEX GmbH of Heilsbronn, Germany, under the TRIZIP™ brand. A problem with using such very heavyweight and expensive waterproof zippers on tombstone shaped backpacks is that such zippers are incredibly difficult to open around an inverted u-shaped path. Additionally, such zippers are very expensive, and thus, increase manufacturing costs.

Roll-top backpacks, on the other hand, can typically be made waterproof more easily and less expensively by creating a sealed compartment through a compressed roll of welded waterproof (e.g., plastic coated) fabric. However, a drawback of a typical roll-top backpack is that the main interior storage compartment is difficult to access. More specifically, with a typical roll-top backpack, it is difficult to access deep into the bag because the fabric used for the rolling function at the top makes the backpack very tall when the top is unrolled. Further, there are typically multiple buckles to keep the fabric roll compressed, which can be more user-intensive than a single zipper closure that is used in a typical tombstone shaped backpack.

SUMMARY

A backpack, according to an embodiment of the present invention, includes a front panel, a back panel and a side panel attached between at least a portion of the front panel and at least a portion of the back panel to form a main interior storage compartment of the backpack. In accordance with an embodiment, the front panel, the back panel and the side panel are made from one or more types of flexible waterproof fabrics, and the side panel is attached by welded seams between the front panel and the back panel. In accordance with an embodiment, the backpack is tombstone shaped. In accordance with an embodiment, the backpack also has an inverted u-shaped foldable flap including a front region having an upper portion that, when the foldable flap is unfolded, faces outward and is visible. When the foldable flap is unfolded, at least a portion of the front region of the foldable flap extends beyond and substantially perpendicular to an upper portion of the front panel. When the foldable flap is folded over itself twice, no portion of the front region of the foldable flap extends beyond the upper portion of the front panel.

In accordance with an embodiment, an inverted u-shaped aperture, which is included in upper portion of the front region of the foldable flap, is selectively openable when the foldable flap is unfolded, to thereby provide access to the main interior storage compartment of the backpack. In accordance with an embodiment, the front region of the foldable flap includes a top portion and a bottom portion, and the inverted u-shaped aperture is included in the top portion of the front region of the foldable flap, but not in the bottom portion of the front region of the foldable flap. In accordance with an embodiment, the foldable flap is configured to be folded back over itself twice so that the upper portion of the front region of the foldable flap, in which the aperture is located, is not visible. The backpack can also include a zipper closure that is configured to enable a person to selectively open and close the inverted u-shaped aperture by opening and closing the zipper closure when the foldable flap is unfolded.

In accordance with an embodiment, the foldable flap is configured to have three configurations including an unfolded configuration, a once folded configuration and a twice folded configuration. In the unfolded configuration, the foldable flap is unfolded, the top portion of the front region of the foldable flap faces outward, and the zipper closure is visible and accessible to enable a person to selectively open and close the inverted u-shaped aperture included in the outwardly facing top portion of the front region of the foldable flap. In the once folded configuration, the foldable flap is folded back over itself once such that the top portion of the front region of the foldable flap faces inward and the zipper closure is not visible and not accessible. In the twice folded configuration, the foldable flap is folded back over itself twice such that the top portion of the front region of the foldable flap faces outward (yet is not visible) and the zipper closure is not visible and not accessible. When folded back over itself twice, the foldable flap provides a waterproof barrier against water or other moisture entering the main interior storage compartment of the backpack through the inverted u-shaped aperture.

In accordance with an embodiment, the foldable flap is at least partially made of a flexible fabric that enables the foldable flap to be folded back over itself. Further, a semi-rigid element can be attached to the bottom portion of the foldable flap, to assist in keeping the foldable flap in its inverted u-shape. Additionally, the semi-rigid element can assist in defining a first fold line at which the foldable flap is folded when the foldable flap is folded back once over itself once, and assist in defining a second fold line at which the foldable flap is folded when the foldable flap is folded back over itself twice.

The backpack can include two shoulder straps attached to the back panel and/or the side panel to allow the backpack to be carried on the back of a wearer. Embodiments of the present invention are also directed to other types of packs or bags besides backpacks, which may or may not include one or more shoulder straps and/or handles.

A pack, according to an embodiment of the present invention, includes a tombstone shaped pack portion made of a flexible material and a main interior storage compartment to accommodate a load to be carried during use of the pack, wherein the main interior storage compartment is located between a front and a back of the pack portion. The pack can also include a foldable flap that when unfolded includes a front lip that extends generally away from the back of the pack portion, and generally towards and past the front of the pack portion. An aperture in an upper portion of the foldable flap is selectively openable, when the foldable flap is unfolded, to provide access to the main interior storage compartment of the backpack. A zipper closure enables a person to selectively open and close the aperture by opening and closing the zipper closure when the foldable flap is unfolded. The foldable flap is configured to be folded to provide a waterproof barrier against water or other moisture entering the main interior storage compartment of the pack through the aperture. In accordance with an embodiment, a height of the tombstone shaped pack when the foldable flap is unfolded is substantially the same as a height of the tombstone shaped pack when the foldable flap is folded to provide the waterproof barrier against water or other moisture entering the main interior storage compartment of the pack through the aperture.

In accordance with an embodiment, when the foldable flap of the pack is unfolded and the zipper closure is fully opened, at least an upper third of the front of the pack portion can be folded downward to increase an area of an opening through the aperture. When the foldable flap is unfolded, a portion of the foldable flap that extends past the front of the pack portion is generally perpendicular to the front of the pack portion. In accordance with an embodiment, the foldable flap, the aperture and the zipper closure each have an inverted u-shape. The pack can be made of flexible waterproof fabric and can have welded and/or taped seams that prevent water from entering the main interior storage compartment through any area other than the aperture. The foldable flap, when folded back over itself twice, provides a waterproof barrier against water entering the main interior storage compartment of the backpack through the aperture. One or more straps can be attached to the pack portion to allow the pack portion to be carried on at least one of a shoulder or back of a wearer.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Figure 1B:
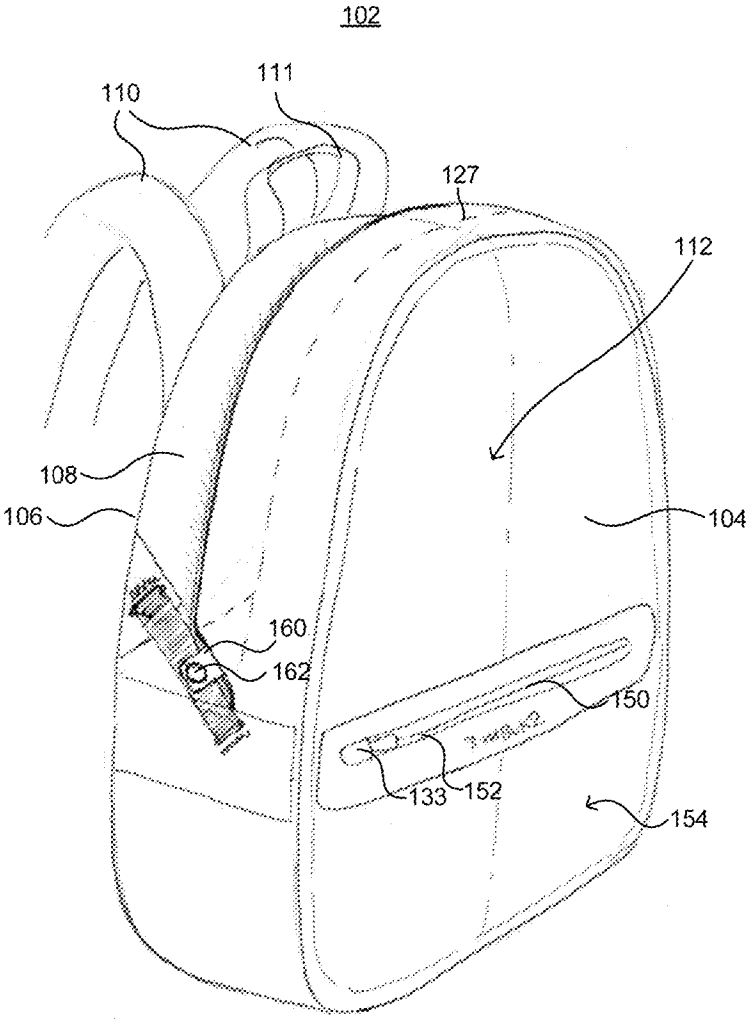
FIG. 1B is a perspective view of the backpack shown in FIG. 1A after the foldable flap of the backpack has been folded twice to provide a waterproof barrier against water or other moisture entering a main interior storage compartment of the backpack through an aperture.
Figure 1A:
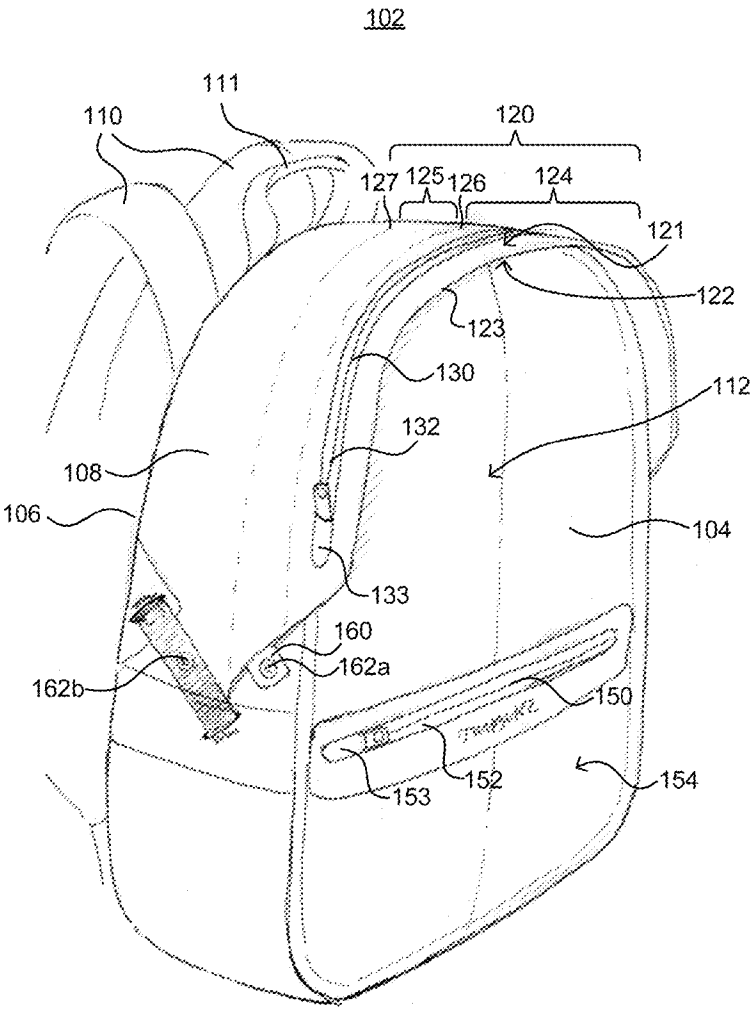
FIG. 1A is a perspective view of a backpack according to an embodiment of the present invention, wherein a foldable flap of the backpack is unfolded.
Figures 1C, 1D, 1E:
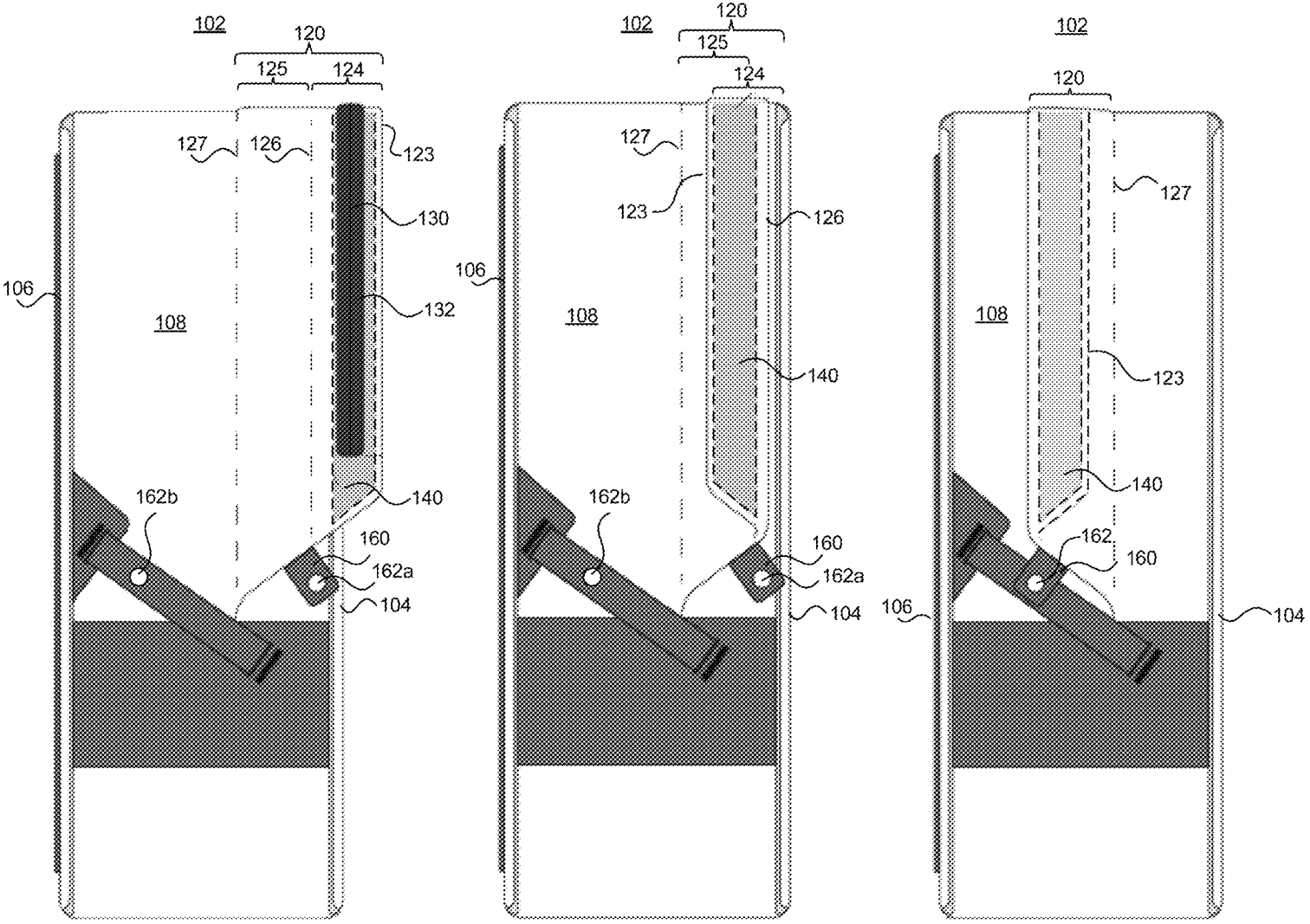
FIG. 1C is a side view of the backpack shown in FIGS. 1A and 1B with the foldable flap of the backpack unfolded.
FIG. 1D is a side view of the backpack shown in FIGS. 1A and 1B with the foldable flap of the backpack folded once.
FIG. 1E is a side view of the backpack shown in FIGS. 1A and 1B with the foldable flap of the backpack folded twice.
Figure 1H:
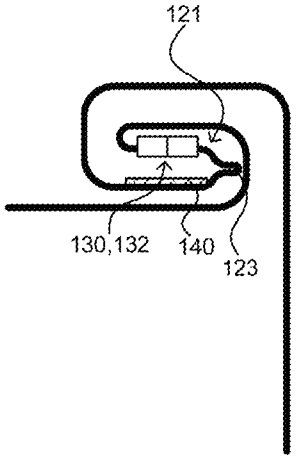
FIG. 1H is a cross-sectional side view of a portion of the foldable flap of the backpack folded twice, and the aperture (which provides access to the main interior storage compartment of the backpack) closed.
Figure 1G:
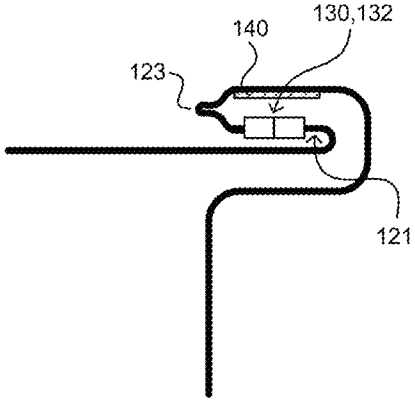
FIG. 1G is a cross-sectional side view of a portion of the foldable flap of the backpack folded once, and the aperture (which provides access to the main interior storage compartment of the backpack) closed.
Figure 1F:
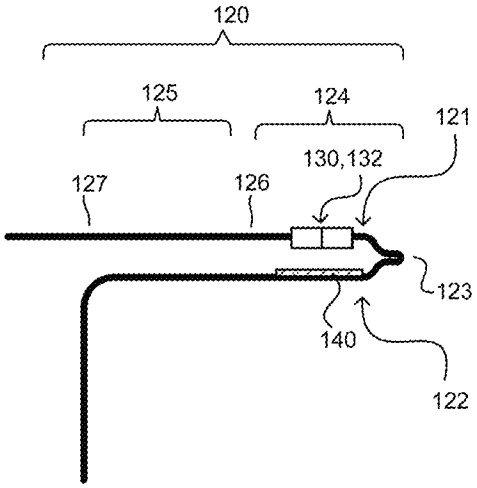
FIG. 1F is a cross-sectional side view of a portion of the foldable flap of the backpack unfolded, and the aperture (which provides access to the main interior storage compartment of the backpack) closed.
Figure 1I:
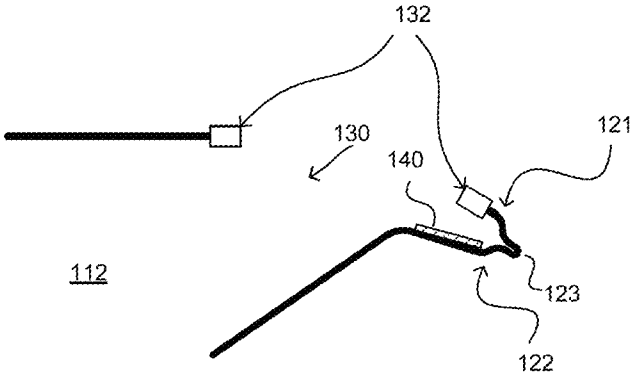
FIG. 1I is a cross-sectional side view of a portion of the foldable flap of the backpack unfolded, and the aperture (which provides access to the main interior storage compartment of the backpack) opened.
Figure 1K:
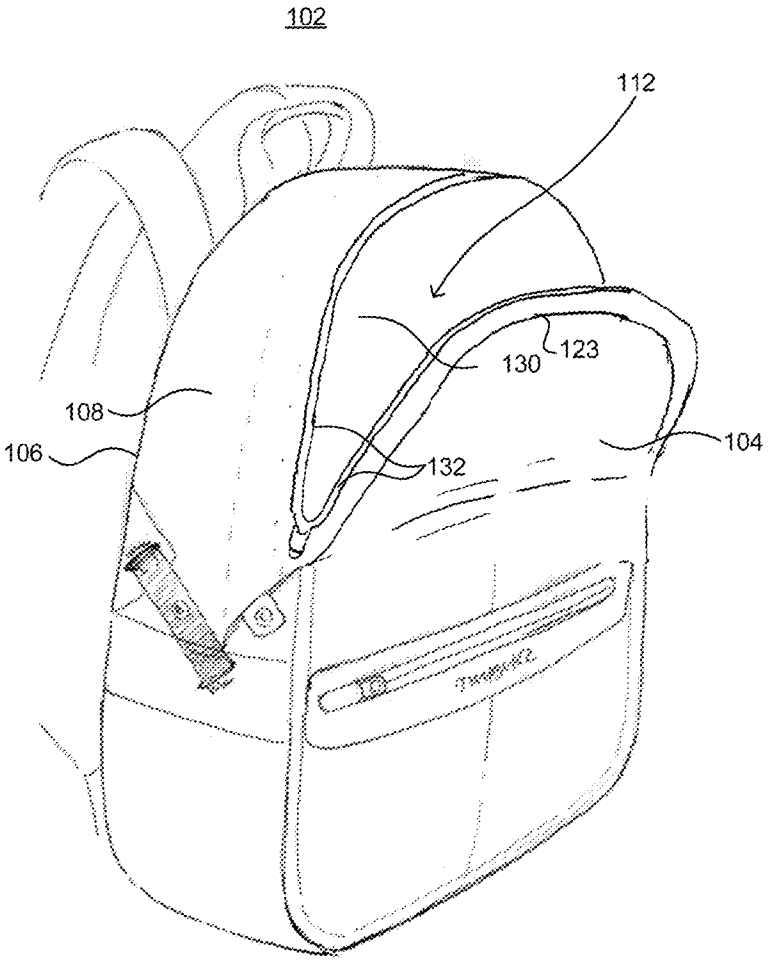
FIG. 1K is similar to FIG. 1J, but shows a portion of the front of the backpack folded down even further to provide more access to the main interior storage compartment of the backpack.
Figure 1J:
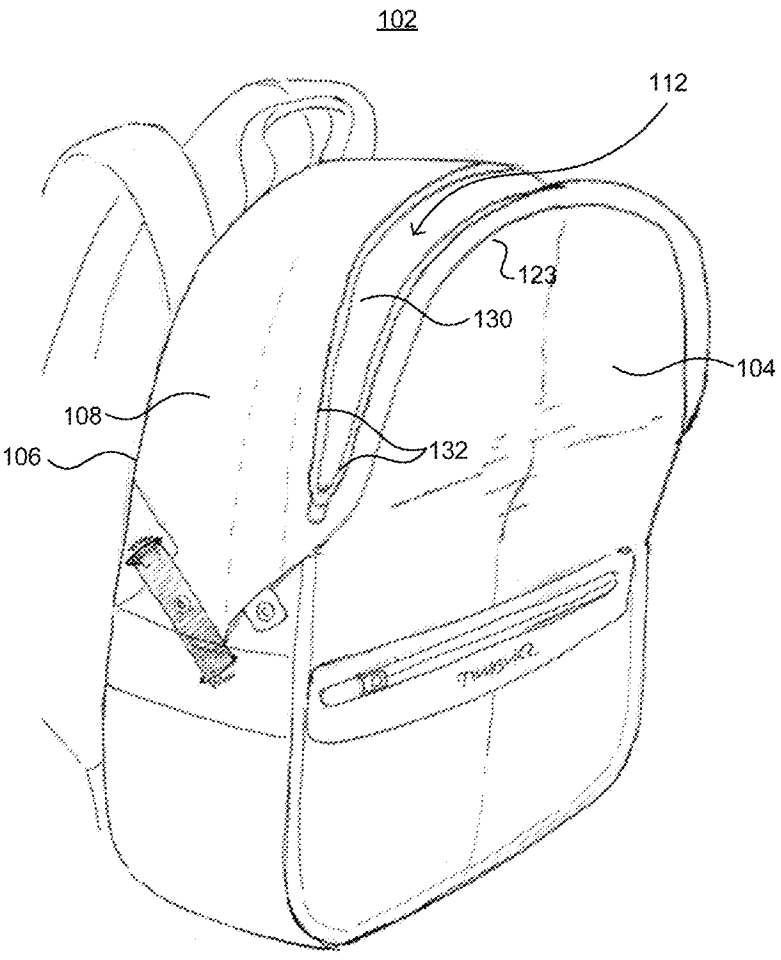
FIG. 1J is a perspective view of the backpack introduced in FIG. 1A, with the foldable flap of the backpack is unfolded, the aperture (which provides access to the main interior storage compartment of the backpack) opened, and a portion of the front of the pack is folded down to provide access to the main interior storage compartment of the backpack.

FIGS. 1A-1K will initially be used to describe a waterproof backpack 102, according to certain embodiments of the present invention, wherein the backpack 102 has a tombstone shape with a main interior storage compartment 112 that is easily accessed via an inverted u-shaped aperture 130 and zipper closure 132 that track around an inverted u-shaped foldable flap 120 in an upper periphery of the backpack 102. More specifically, FIG. 1A is a perspective view of the backpack 102, with its foldable flap 120 is unfolded. FIG. 1B is a perspective view of the backpack 102 after its foldable flap 120 has been folded twice to provide a waterproof barrier against water or other moisture entering the main interior storage compartment 112 through the aperture 130. FIGS. 1C, 1D and 1E are side views of the backpack 102 with its foldable flap 120 in three different configurations, as will be described in more detail below. Certain components of the backpack 102, such as its shoulder straps 110 and handle 111, are not shown in the side views in FIGS. 1C, 1D and 1E. FIGS. 1K and 1J are perspective views of the backpack 102 when opened to allow placement or removal of items into or from the main interior storage compartment 112.

Referring initially to the perspective view of the backpack 102 in FIG. 1A, the backpack 102 is shown as including a front panel 104, a back panel 106, and a side panel 108. The side panel 108, which can also be referred to as a gusset, is attached between at least a portion of the front panel 104 and at least a portion of the back panel 106 to form the main interior storage compartment 112 of the backpack 102. Each of the panels 104, 106 and 108 can be made of a flexible fabric material, such as nylon or canvas, but is not limited thereto. Preferably the one or more flexible fabric materials from which the panels 104, 106 and 108 are manufactured or otherwise treated to be waterproof. For an example, the flexible fabric material can be nylon ripstop CORDURA™, manufactured by INVISTA, which headquartered in Wichita, Kans., United States. Exemplary fabric coatings that can be used to provide waterproofing include coatings such as polyvinylchloride (PVC), polyurethane (PU), polyethylene (PE) and polypropylene (PP) types of coatings, but are not limited thereto. One or more of the panels 104, 106 and 108, and more generally the main interior storage compartment 112, can include an interior lining.

Each of the panels 104, 106 and 108 can be made from a separate sheet of flexible fabric material. It is also possible that any one of the panels 104, 106 and 108 can be made of multiple pieces of flexible fabric material, such that each of the panels may include sub-panels or sections. It is also possible that a portion of one of the panels 104, 106 and 108 is made from a same continuous sheet of flexible material as another one of the panels 104, 106 and 108. Where two of the panels 104, 106 and 108 are attached to one another, or more generally, where separate pieces of flexible fabric material are attached to one another, they are preferably welded to provide waterproof seams. Various different types of fabric welding processes can be used to provide welded seams, including, but not limited to, radio frequency (RF) welding, hot air welding, hot wedge welding and acrylic welding. Instead of, or in addition to welding the various seams, the seams can be sewn and taped. In other words, seams can be only welded; sewn and taped; or welded, sewn and taped. Other variations are also possible.

Still referring to FIG. 1A, the backpack 102 is shown as including a pair of shoulder straps 110 that are attached to portions of the back panel 106 and/or the side panel 108 to allow the backpack 102 to be carried on the back of a person, who can also be referred to as a wearer. Additionally, the backpack 102 is shown as including a handle 111 that enables a person to carry the backpack 102 in one hand. The handle 111 can be made of webbing, and a portion of the webbing can be folded and covered with a thermoplastic polyurethane (TPU), some other heat shrinkable plastic, or some other covering to make the handle more comfortable to hold. Portions of the shoulder straps 110 can also be made of webbing. Webbing can also be used to reinforce various portions of the backpack 102. Portions of the shoulder straps 110 and the back panel 106 can include padding, which can be perforated foam covered by a mesh material, but is not limited thereto.

Also shown in FIG. 1A is the foldable flap 120 in an unfolded configuration, wherein at least a portion of the flap 120 (e.g., a front lip 123 of the flap) extends outward from the side panel 108 beyond an upper portion of the front panel 104. In FIG. 1A, the foldable flap 120 has the same overall shape at the upper portion of the tombstone shaped backpack 102, and thus, the foldable flap 120 has an inverted u-shape. As can be appreciated from FIGS. 1A and 1C, the portion of the foldable flap 120 that extends past the front panel 104 is generally perpendicular to the front panel 104. As the terms are used herein, perpendicular means 90 degrees, and generally perpendicular means any angle between 70 degrees and 110 degrees, inclusive. The foldable flap 120 includes a front region 124 having a top portion 121 and a bottom portion 122 that meet at the front lip 123.

Included in the foldable flap 120 is an aperture 130 that is selectively openable, when the foldable flap 120 is unfolded, to provide access to the main interior storage compartment 112 of the backpack. The aperture 130 is also shown as having an inverted u-shape. The aperture 130 extends through the top portion 121 of a front region 124 of the foldable flap 120, but not through the bottom portion 122 of the front region 124 of the foldable flap 120. This can best be seen in the cross-sections of a portion of the foldable flap 120 shown in FIGS. 1F through 1I.

The foldable flap 120, or at least a portion thereof, can be made from a same continuous sheet of flexible fabric material from which the side panel 108, or at least a portion thereof, is made. It is also possible that the foldable flap 120 is made of one or more sheets of flexible fabric material that are distinct from, yet attached to, one or more sheets of fabric material from which the side panel 108 is made. Preferably the sheet(s) of flexible fabric material from which the foldable flap 120 is made is/are waterproof, as was the case with the panels 104, 106 and 108, as noted above. The top portion 121 and the bottom portion 122 of the front region 124 of the foldable flap 120 can be made of a same continuous sheet of flexible fabric material, folded at the lip 123, or from separate sheets of flexible fabric material that meet at or near the lip 123. In accordance with an embodiment, a distal portion of the flexible fabric material (adjacent to the lip 123) from which the top portion 121 of the foldable flap 120 is made is welded, sewn and/or taped to a distal portion of the flexible fabric material (adjacent to the lip 123) from which the bottom portion 122 of the foldable flap 120 is made, as can best be seen in the cross-sections in FIGS. 1F through 1I.

The main interior storage compartment 112 can be left as a single compartment, or can be subdivided into two or more sub-compartments. Regardless, in accordance with certain embodiments, to maximize waterproofing, the only access to the main interior storage compartment 112 is through the aperture 130 in the foldable flap 120. Accordingly, the aperture 130 may also be referred to as the main aperture 130. By contrast, an auxiliary aperture 150 provides access to an auxiliary pocket-sized compartment 154 that is significantly smaller in volume than the main interior storage compartment 112. The backpack 102 can include additional auxiliary compartments, or none at all.

The backpack 102 is shown as including a zipper closure 132 that can be used to selectively open and close the main aperture 130. Since the zipper closure 132 can open and close the main aperture 130, the zipper closure 132 can also be referred to as the main zipper closure 132. By contrast, an auxiliary zipper closure 152 can be used to selectively open and close the auxiliary aperture 150. Each zipper closure 132 and 152 can include two rows of interdigitated teeth and a slider. The teeth of the zipper closures can be either individual or shaped from a continuous coil. The slider of each zipper closure can include a pull tab and a Y-shaped channel. When the slider is operated by hand the Y-shaped channel moves along the rows of teeth to either mesh together or separates the opposing rows of teeth, depending on the direction of the slider's movement. The backpack 102 can include zipper garages 133 and 153 for each of the zipper closures 132 and 152, respectively, to provide a place for the pull tab of each zipper closure to be stored when the zipper closure is closed, and to reduce the chance that water or other moisture can leak in through the ends of the zipper closures.

In accordance with certain embodiments, the foldable flap 120 is configured to have three configurations, including an unfolded configuration, a once folded configuration, and a twice folded configuration. FIGS. 1F, 1G, 1H are cross-sectional side views of a portion of the foldable flap, respectively, in its unfolded configuration, its once folded configuration and its twice folded configuration, while the main aperture 130 is closed by the zipper closure 132.

The foldable flap 120 is shown as being in its unfolded configuration in FIGS. 1A, 1C and 1F. When the foldable flap 120 is in its unfolded configuration, the top portion 121 of the front region 124 of the foldable flap 120 faces outward (with its center facing upward) such that it is visible, and the zipper closure 132 and its slider are visible and accessible to enable a person to selectively open and close the aperture 130. The terms outward and inward, as used herein, are relative to the main interior storage compartment 112.

The foldable flap 120 is shown as being in its once folded configuration in FIGS. 1D and 1G, during which the foldable flap 120 is folded back over itself once and the top portion 121 of the front region 124 of the foldable flap faces inward (with its center facing downward) such that it is not visible. In this configuration, the zipper closure 130 is not visible and not accessible, and thus, cannot be readily operated to selectively open and close the main aperture 130.

The foldable flap 120 is shown as being in its twice folded configuration in FIGS. 1B, 1E and 1H, during which the foldable flap 120 is folded back over itself twice. In this configuration, the top portion 121 of the front region 124 of the foldable flap 120 faces outward (with its center facing upward), but is not visible and not accessible because it is covered by folded portions of the foldable flap 120. Further, as can be appreciated from FIGS. 1B and 1E, when the foldable flap 120 is in its twice folded configuration, the zipper closure 132 and its slider are not visible, and thus, cannot be readily operated to selectively open and close the main aperture 130. When folded back over itself twice, as shown in FIGS. 1B, 1E and 1H, the foldable flap 120 provides a waterproof barrier against water or other moisture entering the main interior storage compartment 112 of the backpack through the main aperture 130. To maximize waterproofness, the zipper closure 132 should be closed prior to folding the foldable flap 120 back over itself.

Referring to FIGS. 1A, 1C and 1F, the foldable flap 120 includes the front region 124 and a back region 125, which are separated from one another by a first fold line 126 which is represented by a dashed line. The front region 124 of the foldable flap 120 extends between the front lip 123 and the first fold line 126. The back region 125 of the foldable flap 120 extends between the first fold line 126 and a second fold line 127 which is represented by a further dashed line. The main aperture 130 is included in (i.e., extends through) the top portion 121 of the front region 124 of the foldable flap 120, but not through the bottom portion 122 of the front region 124. Accordingly, the main zipper closure 132 is welded and/or taped to or otherwise attached to the top portion 121 of the front region 124 of the foldable flap 120. The first fold line 126 is illustrative of where the foldable flap 120 is folded back once to transition the foldable flap 120 from its unfolded configuration (shown in FIGS. 1A, 1C and 1F) to its once folded configuration (shown in FIGS. 1D and 1G). The second fold line 127 is illustrate of where the foldable flap 120 is folded back a second time to transition the foldable flap 120 from its once folded configuration (shown in FIGS. 1D and 1G) to its twice folded configuration (shown in FIGS. 1B, 1E and 1H).

As shown in FIGS. 1C-1I, in accordance with certain embodiments, the foldable flap 120 includes a semi-rigid element 140 that is welded to, adhered to, stitched into a lining of, or otherwise attached to the bottom portion 122 of the front region 124. Accordingly, the semi-rigid element 140 will also have an inverted u-shape when included in the backpack 102. The semi-rigid element 140 can be made, e.g., from 1 mm polyethylene board, but is not limited thereto. As can be appreciated from FIG. 1C, the width and length of the semi-rigid element 140 can be similar to, but preferably slightly larger than, the dimensions of the main zipper closure 132. The semi-rigid element 140 assists in keeping the foldable flap 120 in its inverted u-shape, assists in defining the first fold line 126 at which the foldable flap 120 is folded back once over itself once, and assists in defining the second fold line 127 at which the foldable flap 120 is folded back twice over itself.

FIG. 1J is a perspective view of the backpack 102 with the foldable flap 120 unfolded and with a portion of the front panel 104 folded down to provide access to the main interior storage compartment 112 of the backpack 102. FIG. 1K is similar to FIG. 1J, but shows a portion of the front panel 104 of the backpack 102 folded down even further to provide even more access to the main interior storage compartment 112. FIGS. 1J and 1K illustrate that the backpack 102 provides easy access to the main interior storage compartment 112, which makes tombstone shaped backpacks so popular and often preferred over typical roll-top backpacks. This preference, as noted above in the background, is because it is often difficult to access an interior main compartment of a typical roll-top backpack due to the fabric used for the rolling function at the top of the typical roll-top backpack being very tall when unrolled. As can be appreciated from FIGS. 1J and 1K, at least an upper third of the front panel 104 can be folded downward to increase an area of an opening through the main aperture 130 to accommodate the placement and removal of a load to be carried within the main interior storage compartment 112. Such a load can include books, clothes, food, matches, electronic devices and/or any other types of goods that a person may desire to carry and keep dry. FIG. 1I is a cross-sectional side view of a portion of the foldable flap 120 unfolded and the main aperture 130 opened to provide access to the main interior storage compartment 112 of the backpack 102.

A benefit of the backpack 102 over a typical tombstone shaped backpack is that the foldable flap 120 can be folded back over itself twice, to be in the configuration shown in FIGS. 1B, 1E and 1H, to thereby provide a waterproof barrier against water or other moisture entering the main interior storage compartment 112 of the backpack 102 through the main aperture 130. By contrast, primarily relying on a heavyweight waterproof zipper closure to make a typical tombstone shaped backpack waterproof would make the backpack very difficult to open and quite expensive. (Nevertheless, it is possible that the zipper closure 132 can be, if desired, such a heavyweight waterproof zipper closure.) A benefit of the backpack 102 over a typical roll-top backpack is that the main interior storage compartment 112 of the backpack 102 is easily accessible. By contrast, accessing the main interior storage compartment of a typical roll-top backpack is difficult due to the fabric at the top of the typical roll-top backpack being very tall when unrolled. Further, with a typical roll-top backpack, after rolling the fabric at the top of the bag, multiple buckles, or the like, typically need to be fastened or otherwise utilized to keep the fabric roll compressed, which can be more user-intensive than simply closing the zipper closure 132 and folding back the foldable flap 120 of the backpack 102. Accordingly, the backpack 102 provides certain benefits of a typical tombstone shaped backpack (namely, easy access the main interior storage compartment) and certain benefits of a typical roll-top backpack (namely, utilizing a rolled material to provide a water waterproof barrier against water or other moisture entering the main interior storage compartment). Beneficially, the backpack 102 overcomes certain problems associated with a typical tombstone shaped backpack (namely, potential difficulties and expenses associated with making them waterproof) and certain problems associate with a typical roll-top backpack (namely difficulties associated with accessing the main interior storage compartment due to the fabric at the top of the typical roll-top backpack being very tall when unrolled).

As can be appreciated from a comparison between FIGS. 1A and 1B, as well as a comparison between FIGS. 1C and 1E, a height of the backpack 102 when the foldable flap 120 is unfolded is substantially the same as a height of the backpack 102 when the foldable flap 120 is folded to provide the waterproof barrier against water or other moisture entering the main interior storage compartment 112 through the aperture 130. Thus, the backpack 102 provides the waterproof advantages of a typical roll-top backpack without the disadvantage of increasing the height of the backpack when in its unrolled or unfolded configuration.

Referring again to FIG. 1A, in accordance with an embodiment, a tab 160 having a first half of a fastener 162*a* (e.g., a female or male portion of a snap) extends from a portion of the foldable flap 120, and a second half of the fastener 162*b* (e.g., a male or female portion of a snap) is attached to the side panel 108, directly, or to webbing attached thereto. As shown in FIG. 1B, when the foldable flap 120 is in its twice folded configuration, the first and second halves of the fastener 162*a*, 162*b* can be fastened to one another, to help keep the foldable flap 120 in its twice folded configuration until a person purposely unfolds the flap 120. The first and second halves of the fastener 162*a*, 162*b* can be collectively referred to as the fastener 162. The fastener 162 can alternatively be a hook and loop type fastener, a buckle, a snap buckle, or other type of fastener. While only shown in the left side of the side panel 108 in FIGS. 1A and 1B, the tab 160 and fastener 162 can also be included on the right side of the side panel 108, which is not visible in the perspective views in FIGS. 1A and 1B.

Figure 2B:
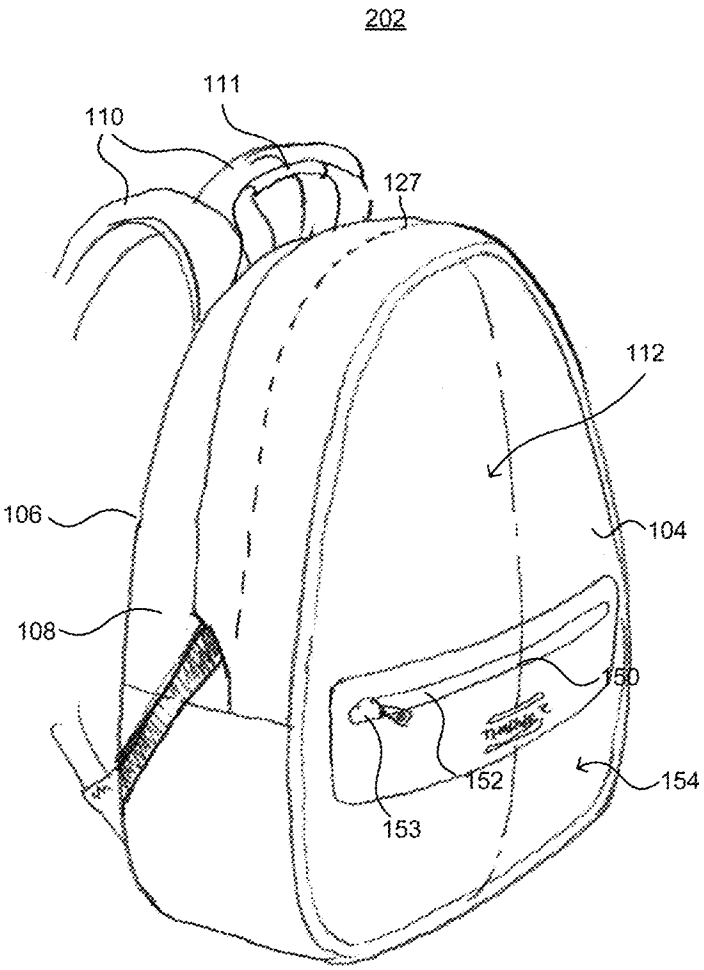
FIG. 2B is a perspective view of the backpack shown in FIG. 2A after the foldable flap of the backpack has been folded twice to make the backpack waterproof.
Figure 2A:
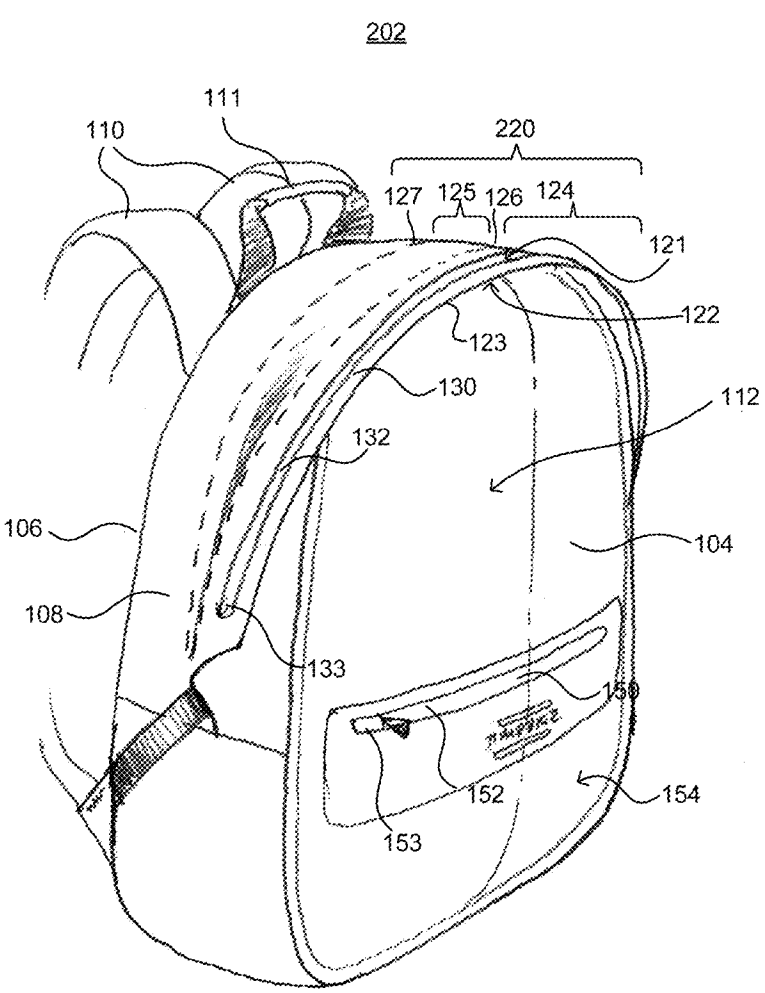
FIG. 2A is a perspective view of a backpack according to another embodiment of the present invention, wherein the foldable flap of the backpack is unfolded.
Figure 2D:
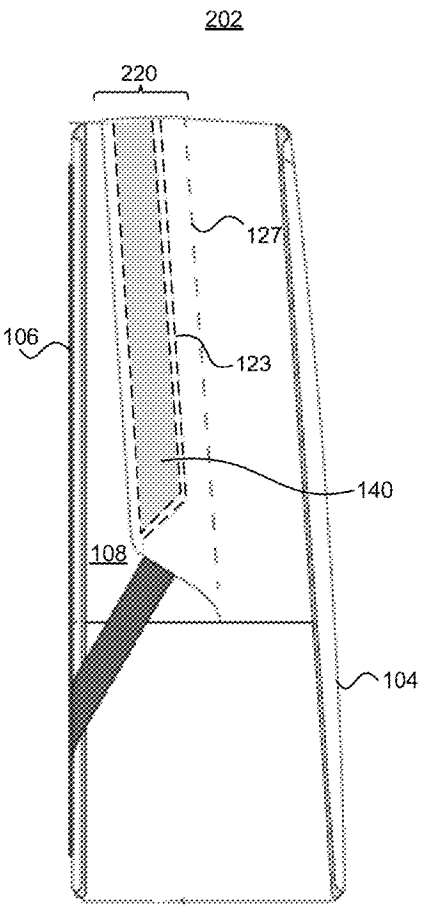
FIG. 2D is a side view of the backpack shown in FIGS. 2A and 2B with the foldable flap of the backpack folded twice.
Figure 2C:
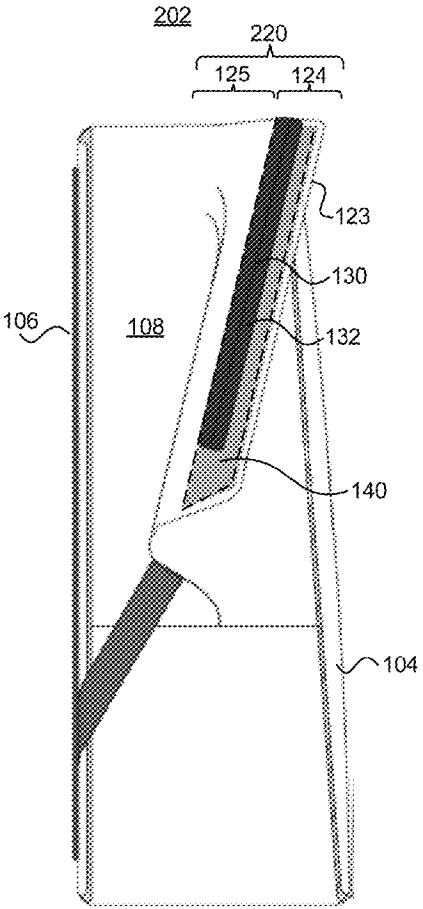
FIG. 2C is a side view of the backpack shown in FIGS. 2A and 2B with the foldable flap of the backpack unfolded.

FIG. 2A is a perspective view of a backpack 202 according to another embodiment of the present invention, wherein a foldable flap 220 of the backpack 202 is unfolded. FIG. 2B is a perspective view of the backpack 202 shown in FIG. 2A after the foldable flap 220 of the backpack 202 has been folded twice to provide a waterproof barrier against water or other moisture entering a main interior storage compartment of the backpack through a main aperture. FIG. 2C is a side view of the backpack 202 shown in FIGS. 2A and 2B with the foldable flap 220 of the backpack unfolded. FIG. 2D is a side view of the backpack 202 shown in FIGS. 2A and 2B with the foldable flap 220 of the backpack folded twice. The foldable flap 220 includes similar components as and functions in a similar manner as the foldable flap 120, which was described above, and thus, details of its components and functionality need not be repeated. Where components of the backpack 202 and its foldable flap 220 are the same or substantially the same as those of the backpack 102 and its foldable flap 120, the same reference numbers have been used. For example, Referring to FIGS. 2A-2D, the foldable flap 220 includes a front region 124 and a back region 125, which are separated from one another by a first fold line 126 which is represented by a dashed line. The front region 124 of the foldable flap 220 extends between the front lip 123 and the first fold line 126. The back region 125 of the foldable flap 220 extends between the first fold line 126 and a second fold line 127 which is represented by a further dashed line. As was the case with the foldable flap 120, the foldable flap 220 is also configured to have three configurations, including an unfolded configuration, a once folded configuration, and a twice folded configuration.

One distinction between the foldable flap 220 and the foldable flap 120 is that the foldable flap 220, when unfolded and viewed from the side (e.g., in FIGS. 2A and 2C) is at an angle relative to a front panel 106 of the backpack 202. This angling of the foldable flap 220 makes it less likely to unfold on its own, when in its twice folded configuration, alleviating the potential need for a tab and fastener (similar to the tab 160 and the fastener 162 shown in and discussed with reference to FIGS. 1A and 1B).

While the carrying bags shown in and described above with reference to the figures were shown and described as being backpacks, many features of the embodiments described herein can be incorporated into other types of packs, and more generally, into other types of carrying bags. For example, an alternative pack that includes features of the embodiments described above can include a single shoulder strap or handle, instead of a pair of shoulder straps. It is also possible that features of the embodiments described above can be implemented into a messenger bag, a pannier or saddle bag, or in a pack that is intended to be attached to the underside of a bicycle seat. Other variations are also possible. More generally, features described herein can be usefully added to most any type of pack where there is a desire to make the pack waterproof while still allowing easy access to a main interior storage compartment.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A backpack, comprising:

a front panel;

a back panel;

a side panel attached between at least a portion of the front panel and at least a portion of the back panel to form a main interior storage compartment of the backpack;

an inverted u-shaped foldable flap including a front region having an upper portion that, when the foldable flap is unfolded, faces outward and is visible;

an inverted u-shaped aperture in the upper portion of the front region of the foldable flap;

wherein the aperture is selectively openable, when the foldable flap is unfolded, to provide access to the main interior storage compartment of the backpack; and wherein the foldable flap is configured to be folded back over itself twice so that the upper portion of the front region of the foldable flap, in which the aperture is located, is not visible.

2. The backpack of claim 1, further comprising a zipper closure configured to enable a person to selectively open and close the inverted u-shaped aperture by opening and closing the zipper closure when the foldable flap is unfolded.

3. The backpack of claim 2, wherein:

the front region of the foldable flap includes a top portion and a bottom portion; and the inverted u-shaped aperture is included in the top portion of the front region of the foldable flap, but not in the bottom portion of the front region of the foldable flap.

4. The backpack of claim 3, wherein the foldable flap is configured to have three configurations including:

an unfolded configuration wherein the foldable flap is unfolded, the top portion of the front region of the foldable flap faces outward, and the zipper closure is visible and accessible to enable a person to selectively open and close the inverted u-shaped aperture included in the outwardly facing top portion of the front region of the foldable flap;

a once folded configuration wherein the foldable flap is folded back over itself once such that the top portion of the front region of the foldable flap faces inward and the zipper closure is not visible and not accessible; and a twice folded configuration wherein the foldable flap is folded back over itself twice such that the top portion of the front region of the foldable flap faces outward and the zipper closure is not visible and not accessible.

5. The backpack of claim 4, wherein the foldable flap, when folded back over itself twice, provides a waterproof barrier against water or other moisture entering the main interior storage compartment of the backpack through the u-shaped aperture.

6. The backpack of claim 5, wherein the foldable flap is at least partially made of a flexible fabric that enables the foldable flap to be folded back over itself.

7. The backpack of claim 6, further comprising a semi-rigid element is attached to the bottom portion of the foldable flap.

8. The backpack of claim 7, wherein the semi-rigid element assists in keeping the foldable flap in its inverted u-shape.

9. The backpack of claim 8, wherein the semi-rigid element assists in defining a first fold line at which the foldable flap is folded when the foldable flap is folded back once over itself once, and assists in defining a second fold line at which the foldable flap is folded when the foldable flap is folded back over itself twice.

10. The backpack of claim 1, wherein at least a portion of the side panel and at least a portion of the foldable flap are made of a same continuous sheet of flexible fabric.

11. The backpack of claim 1, further comprising two shoulder straps attached to the back panel and/or the side panel to allow the backpack to be carried on the back of a wearer.

12. The backpack of claim 1, wherein the front panel, the back panel and the side panel are made from one or more types of flexible waterproof fabrics, and wherein the side panel is attached by welded and/or taped seams between at least a portion of the front panel and the at least a portion of the back panel to form the main interior storage compartment of the backpack.

13. The backpack of claim 1, wherein the backpack is tombstone shaped.

14. The backpack of claim 1, wherein:

when the foldable flap is unfolded, at least a portion of the front region of the foldable flap extends beyond and substantially perpendicular to an upper portion of the front panel; and when the foldable flap is folded over itself twice, no portion of the front region of the foldable flap extends beyond the upper portion of the front panel.

15. A pack, comprising:

a tombstone shaped pack portion made of a flexible material and including a main interior storage compartment to accommodate a load to be carried during use of the pack, wherein the main interior storage compartment is located between a front and a back of the pack portion;

a foldable flap that when unfolded includes a front lip that extends generally away from the back of the pack portion, and generally towards and past the front of the pack portion;

an aperture in an upper portion of the foldable flap that is selectively openable, when the foldable flap is unfolded, to provide access to the main interior storage compartment of the backpack;

a zipper closure configured to enable a person to selectively open and close the aperture by opening and closing the zipper closure when the foldable flap is unfolded;

wherein the foldable flap is configured to be folded to provide a waterproof barrier against water or other moisture entering the main interior storage compartment of the pack through the aperture.

16. The pack of claim 15, wherein when the foldable flap is unfolded and the zipper closure is fully opened, at least an upper third of the front of the pack portion can be folded downward to increase an area of an opening through the aperture.

17. The pack of claim 15, wherein when the foldable flap is unfolded, a portion of the foldable flap that extends past the front of the pack portion is generally perpendicular to the front of the pack portion.

18. The pack of claim 15, wherein the foldable flap, the aperture and the zipper closure each have an inverted u-shape.

19. The pack of claim 15, further comprising one or more straps attached to the pack portion to allow the pack portion to be carried on at least one of a shoulder or back of a wearer.

20. The pack of claim 15, wherein a height of the tombstone shaped pack when the foldable flap is unfolded is substantially the same as a height of the tombstone shaped pack when the foldable flap is folded to provide the waterproof barrier against water or other moisture entering the main interior storage compartment of the pack through the aperture.

21. A pack, comprising:

a pack portion made of a flexible material and including a main interior storage compartment;

a foldable flap including a front region having an upper portion that, when the foldable flap is unfolded, faces outward and is visible;

an aperture in the upper portion of the front region of the foldable flap;

wherein the aperture is selectively openable, when the foldable flap is unfolded, to provide access to the main interior storage compartment of the pack;

wherein the foldable flap is configured to be folded back over itself twice so that the upper portion of the front region of the foldable flap, in which the aperture is located, is not visible; and wherein a height of the pack when the foldable flap is unfolded is substantially the same as a height of the pack when the foldable flap is folded back over itself twice.

22. The pack of claim 21, further comprising a zipper closure configured to enable a person to selectively open and close the aperture by opening and closing the zipper closure when the foldable flap is unfolded.

23. The backpack of claim 21, wherein the pack is made of flexible waterproof fabric and includes welded and/or taped seams that prevent water from entering the main interior storage compartment through any area other than the aperture, and wherein the foldable flap, when folded back over itself twice, provides a waterproof barrier against water entering the main interior storage compartment of the backpack through the aperture.

24. The pack of claim 21, wherein the foldable flap, the aperture and the zipper closure each have an inverted u-shape.

* * * * *